US007207171B2

(12) United States Patent
Nagaoka et al.

(10) Patent No.: US 7,207,171 B2
(45) Date of Patent: Apr. 24, 2007

(54) EXHAUST GAS PURIFYING METHOD AND EXHAUST GAS PURIFYING SYSTEM

(75) Inventors: Daiji Nagaoka, Fujisawa (JP); Masashi Gabe, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 73 days.

(21) Appl. No.: 10/926,331

(22) Filed: Aug. 26, 2004

(65) Prior Publication Data

US 2005/0050884 A1 Mar. 10, 2005

(30) Foreign Application Priority Data

Aug. 29, 2003 (JP) ..... 2003-306284

(51) Int. Cl.
*F01N 3/00* (2006.01)

(52) U.S. Cl. ..... 60/295; 60/285; 60/297; 60/301

(58) Field of Classification Search ..... 60/278, 60/280, 285, 295, 297, 301, 311
See application file for complete search history.

(56) References Cited

U.S. PATENT DOCUMENTS 5,746,989 A * 5/1998 Murachi et al. ..... 423/213.7
6,167,696 B1 * 1/2001 Maaseidvaag et al. ..... 60/274
6,779,339 B1 * 8/2004 Laroo et al. ..... 60/297
6,813,882 B2 * 11/2004 Hepburn et al. ..... 60/286
6,832,473 B2 * 12/2004 Kupe et al. ..... 60/286
6,962,045 B2 * 11/2005 Kitahara et al. ..... 60/295

FOREIGN PATENT DOCUMENTS

JP 9-53442 2/1907
JP 2000/192811 7/2000

* cited by examiner

*Primary Examiner*—Binh Q. Tran
(74) *Attorney, Agent, or Firm*—Staas & Halsey LLP

(57) ABSTRACT

To provide an exhaust gas purifying method and an exhaust gas purifying system capable of efficiently purging the sulfur accumulated in a NOx occluding reduction type catalyst, while preventing fuel consumption from deteriorating and preventing NOx, HC, and CO from being discharged into the atmosphere, in an exhaust gas purifying system constituted by combining a NOx purifying function by the NOx occluding reduction type catalyst with a PM purifying function by a DPF. In an exhaust gas purifying system (1) for performing NOx purification by a NOx occluding reduction type catalyst (42) and PM purification by an DPF (41), it is judged whether sulfur purge of the NOx occluding reduction type catalyst is required and when it is judged that the sulfur purge is required, it is further judged whether the PM quantity (PMst) accumulated in the DPF (41*b*) exceeds a predetermined judgment value (PMst0), and when the PM quantity (PMst) exceeds the judgment value (PMst0), sulfur purge control is performed after performing the DPF regeneration control.

2 Claims, 5 Drawing Sheets

EXHAUST GAS PURIFYING METHOD AND EXHAUST GAS PURIFYING SYSTEM

BACKGROUND OF THE INVENTION

The present invention relates to an exhaust gas purifying method and an exhaust gas purifying system for purifying NOx by a NOx occluding reduction type catalyst and purifying PM by a DPF.

Legal restriction on discharge quantities of NOx (nitrogen oxide) and particulate matter (hereafter referred to as PM) is enforced year by year together with legal restriction on discharge quantities of CO (carbon monoxide) and HC (carbon hydride). Thus, only improvement of an engine cannot manage a restriction value for the enforcement of the restriction. Therefore, a technique is adopted which reduces these matters discharged from an engine by mounting an exhaust gas control system.

Moreover, many NOx purifying catalysts are developed for NOx and a filter referred to as a diesel particulate filter (hereafter referred to as DPF) is developed for the PM.

A NOx occluding reduction type catalyst is one of the NOx purifying catalysts. In the NOx occluding reduction type catalyst, a catalyst metal having an oxidizing function for NOx and a NOx occluding material having a NOx occluding function are supported on a porous catalyst coat layer such as alumina ($Al_2O_3$). The catalyst metal is formed by platinum (Pt) and so on. The NOx occluding material is formed by one of or a combination of some of alkaline metals such as sodium (Na), potassium (K), and cesium (Cs), alkaline earth metals such as calcium (Ca) and barium (Ba), and rare earths such as yttrium (Y) and lanthanum (La). The NOx occluding reduction type catalyst shows two functions depending on the $O_2$ (oxygen) concentration in exhaust gas. One is a function of occlusion of NOx. And the other is a function of release and purification of NOx.

First, in the case of an exhaust gas condition (lean air-fuel ratio state) having a high $O_2$ concentration in the exhaust gas such as a normal operational state of a diesel engine or a lean-burn gasoline engine or the like, NO (nitrogen monoxide) is oxidized by $O_2$ contained in exhaust gas as a result of the oxidizing function of the catalyst metal to become $NO_2$ (nitrogen dioxide). The $NO_2$ is occluded in the NOx occluding material in the form of chloride. In this manner, the exhaust gas is thus purified.

However, when occlusion of the NOx continues, the NOx occluding material such as barium is changed to nitrate. Accordingly, the NOx occluding material is gradually saturated to lose the function for occluding NOx. To avoid such situation, over-rich combustion is performed by changing operation conditions of the engine to generate exhaust gas (rich spike gas) having a low $O_2$ concentration, high CO concentration, and high exhaust gas temperature and supply the exhaust gas to the catalyst.

In the rich air-fuel ratio state of the exhaust gas, the NOx occluding material changed to nitrate by occluding $NO_2$ releases the occluded $NO_2$ and returns to the original substance such as barium. Because $O_2$ is not present in the exhaust gas, the released $NO_2$ is reduced on the catalyst metal by using CO, HC, and $H_2$ in the exhaust gas as reducers. That is, these components are converted into $N_2$, $H_2$, O, and $CO_2$. In this manner, the NOx in the exhaust gas is purified.

However, when using the NOx occluding reduction type catalyst, it is impossible to burn a soot component in PM by the catalyst alone. Therefore, as disclosed in Japanese Patent Laid-Open No. 1997-53442, it is required to combine the catalyst with a DPF or integrate the NOx purifying function of the NOx occluding reduction type catalyst with the PM purifying function of the DPF. Moreover, it is required to combine both in order to purify the NOx generated in regeneration of the DPF.

The NOx occluding reduction type catalyst has a problem in that sulfur in fuel is accumulated in the NOx occluding material, and the NOx purifying efficiency is deteriorated as the operation of the engine continues. Therefore, as disclosed in Japanese Patent Laid-Open No. 2000-192811, in spite of difference between the types of the catalyst to be used, it is required to perform sulfur purge control (sulfur desulfurization control) by keeping the exhaust gas flowing into the catalyst in the condition of a temperature higher than approximately 600 to 650° C. and a rich atmosphere.

The sulfur purge control accelerates sulfur purge by bringing the exhaust gas into the rich state and raising the temperature of the catalyst by the oxidation activation reaction heat generated at the catalyst. In the case of a diesel engine, the rich state is realized by reducing the intake volume through intake-air throttling or through a large quantity of EGR and by performing post injection as well as directly adding light oil to a post injection or an exhaust pipe.

However, the sulfur purge for recovering the NOx occluding function of the catalyst by increasing the quantity of sulfur purge has the following problems.

Because the oxygen concentration in exhaust gas is very low under a rich air-fuel-ratio state, the time required to raise the temperature of the catalyst up to a temperature at which the sulfur purge can be made becomes very long. Therefore, fuel consumption is deteriorated. Moreover, the quantity of sulfur purge increases as rich is denser. However, when performing a dense rich state operation, fuel consumption is extremely deteriorated. Moreover, a problem of slip of HC or CO occurs that HC or CO is generated in a large quantity and some of HC or CO is discharge into atmosphere.

Furthermore, in the case of a DPF, a continuously regenerating type DPF is developed which is constituted by combining an oxidation catalyst or the like with the DPF in order to burn and remove PM. In the DPF, the PM can be burned and removed at a comparatively low temperature. However, in a state where an exhaust gas temperature is low and clogging of the DPF progresses, exhaust gas temperature raising control such as an intake-air throttling is performed to temporarily raise the temperature of exhaust gas in order to burn and remove the collected PM.

SUMMARY OF THE INVENTION

It is an object of the present invention to provide an exhaust gas purifying method and an exhaust gas purifying system capable of efficiently purging the sulfur accumulated in a NOx occluding reduction type catalyst, while preventing fuel consumption from deteriorating and preventing NOx, HC, and CO from being discharged into atmosphere, in an exhaust gas purifying system constituted by combining the NOx purifying function of a NOx occluding reduction type catalyst with the PM purifying function of a DPF.

The exhaust gas purifying method for achieving the above object is a method using an exhaust gas purifying system which performs NOx purification by a NOx occluding reduction type catalyst and PM purification by a DPF for the exhaust gas of an internal combustion engine and has a control unit, the control unit being provided with a regeneration start judgment means of a NOx catalyst, a NOx catalyst regeneration control means, a sulfur purge start judgment means, a sulfur purge control means, a PM accumulation quantity calculating means, a DPF regeneration start judgment means, and a DPF regeneration control means, comprises the steps of, judging whether the sulfur purge of a NOx occluding reduction type catalyst is required, further judging whether the PM accumulation quantity collected in the DPF exceeds a predetermined value when the sulfur purge is judged to be required, and performing a sulfur purge control after performing the DPF regeneration control when the PM quantity exceeds the predetermined value.

Moreover, an exhaust gas purifying system for achieving the above object uses an exhaust gas purifying system which performs NOx purification by a NOx occluding reduction type catalyst and PM purification by a DPF for the exhaust gas of an internal combustion engine and has a control unit, the control unit being provided with a NOx-catalyst regeneration start judgment means, a NOx catalyst regeneration control means, a sulfur purge start judgment means, a sulfur purge control means, a PM accumulation quantity calculating means, a DPF regeneration start judgment means, and a DPF regeneration control means, in which whether the sulfur purge of a NOx occluding reduction type catalyst is required is judged, whether the PM accumulation quantity collected in the DPF exceeds a predetermined value is further judged when the sulfur purge is judged to be required, and a sulfur purge control is performed after performing the DPF regeneration control when the PM quantity exceeds the predetermined value.

Whether or not the sulfur purge of the NOx occluding reduction type catalyst is required can be judged in accordance with whether or not the accumulated sulfur quantity calculated based on fuel consumption and the sulfur quantity contained in fuel. Another judgment method, however, may be used.

Moreover, for judging whether or not the PM accumulation quantity collected in the DPF exceeds a predetermined judgment value, the PM accumulation quantity may be computed by calculating of the PM generation quantity with reference to the PM generation map from the course of the operation states of the engine and by cumulative adding of these PM generation quantities. A PM accumulation quantity estimated in accordance with the differential pressure between the front and the rear of the DPF may be also used. Furthermore, the value which is not a physical quantity directly indicating the PM accumulation quantity may be compared with a reference value. The present invention includes these cases. It means that, for example, a case of indirectly judging whether the PM accumulation quantity exceeds a predetermined judgment value by comparing the differential pressure between the front and the rear of the DPF with a predetermined judgment value is also included.

Furthermore, in the case of the exhaust gas purifying system of the present invention, the DPF can be constituted of a DPF constituted of only a filter; a continuously regenerating type DPF formed by an upstream-side oxidation catalyst and a downstream-side DPF; a continuously regenerating type DPF formed by a DPF with a catalyst supporting an oxidation catalyst; or a continuously regenerating type DPF formed by a DPF with a catalyst supporting both an oxidation catalyst and a PM oxidation catalyst.

The continuously regenerating type DPF constituted of the upstream-side oxidation catalyst and the down-stream-side DPF is a continuously regenerating type DPF referred to as CRT (Continuously Regenerating Trap) DPF. NO in exhaust gas is oxidized to $NO_2$ by the upstream-side oxidation catalyst. Because the $NO_2$ has an energy barrier smaller than that of $O_2$, the PM collected in the DPF at a low temperature can be oxidized and removed.

Moreover, the continuously regenerating type DPF formed by the DPF carrying the oxidation catalyst oxidizes the PM accumulated in the DPF by $NO_2$ generated due to oxidation of NO. The continuously regenerating type DPF constituted of the DPF supporting the oxidation catalyst and the PM oxidation catalyst directly burns the PM accumulated in the DPF with $O_2$ even in a lower temperature condition and continuously regenerates the PM by carrying the oxidation catalyst and the PM oxidation catalyst on the DPF.

Furthermore, the above exhaust gas purifying system may be either an exhaust gas purifying system having a NOx reduction type catalyst and a continuously regenerating type DPF in the exhaust passage of an internal combustion engine, or an exhaust gas purifying system provided with a continuously regenerating type DPF having a DPF supporting a NOx reduction type catalyst.

Particularly, by making a NOx occluding reduction type catalyst support on the DPF with the catalyst to integrate them, it is possible to simultaneously purify PM and NOx. That is, when exhaust gas is in a lean air-fuel ratio state in lean burn, NOx is occluded in the NOx occluding material of the catalyst. PM is oxidized by the active oxygen (O*) and $O_2$ in the exhaust gas, which are generated at the time of NOx occlusion. Moreover, when the exhaust gas is in a rich air-fuel ratio state through theoretical air-fuel-ratio combustion or over-rich air-fuel-ratio combustion for regenerating the NOx occlusion capacity, NOx is discharged from the NOx occluding material and even if the quantity of $O_2$ in the exhaust gas is small, PM is oxidized in the catalyst by the active oxygen (O*) generated at the time of reduction of NOx. According to this constitution, because the NOx occluding reduction type catalyst and the catalyst-carrying DPF are integrated, it is possible to downsize and simplify the system.

Furthermore, when the DPF and the NOx occluding reduction type catalyst are separated from each other, even if the DPF is set at the downstream side of the NOx occluding reduction type catalyst, the sulfur purge of the NOx occluding reduction type catalyst is performed after raising the temperature of exhaust gas to remove PM from the DPF. Therefore, it is possible to obtain an advantage of reducing fuel consumption. However, when the DPF is set at the upstream side of the NOx occluding reduction type catalyst, the exothermic effect due to burning of the PM collected by the DPF can be also used for the exhaust gas temperature rise for performing the sulfur purge of the NOx occluding reduction type catalyst. Therefore, an advantage of further reducing fuel consumption can be obtained. Thus, when the DPF and the NOx occluding reduction type catalyst are separated from each other, it is more preferable to set the DPF at the upstream side of the NOx occluding reduction type catalyst.

According to the exhaust gas purifying method and the exhaust gas purifying system of the present invention, regeneration control of the DPF is performed and thereafter the sulfur purge control of the NOx occluding reduction type catalyst is performed. Therefore, it is possible to perform the sulfur purge of the NOx occluding reduction type catalyst by using the raise of the exhaust gas temperature and the temperature of the NOx occluding reduction type catalyst when performing the regeneration control of the DPF for forcibly burning collected PM. Therefore, it is possible to decrease the time and fuel consumption relating to the raise of the temperature of the NOx occluding reduction type catalyst. Consequently, it is possible to efficiently and effectively purge sulfur while preventing the fuel consumption from deteriorating and preventing NOx, HC, and CO from being discharged to the atmosphere.

DETAILED DESCRIPTION OF THE PREFERRED EMBODIMENT

An exhaust gas purifying method and an exhaust gas purifying systems of embodiments of the present invention are described below by referring to the accompanying drawings.

Figure 1:
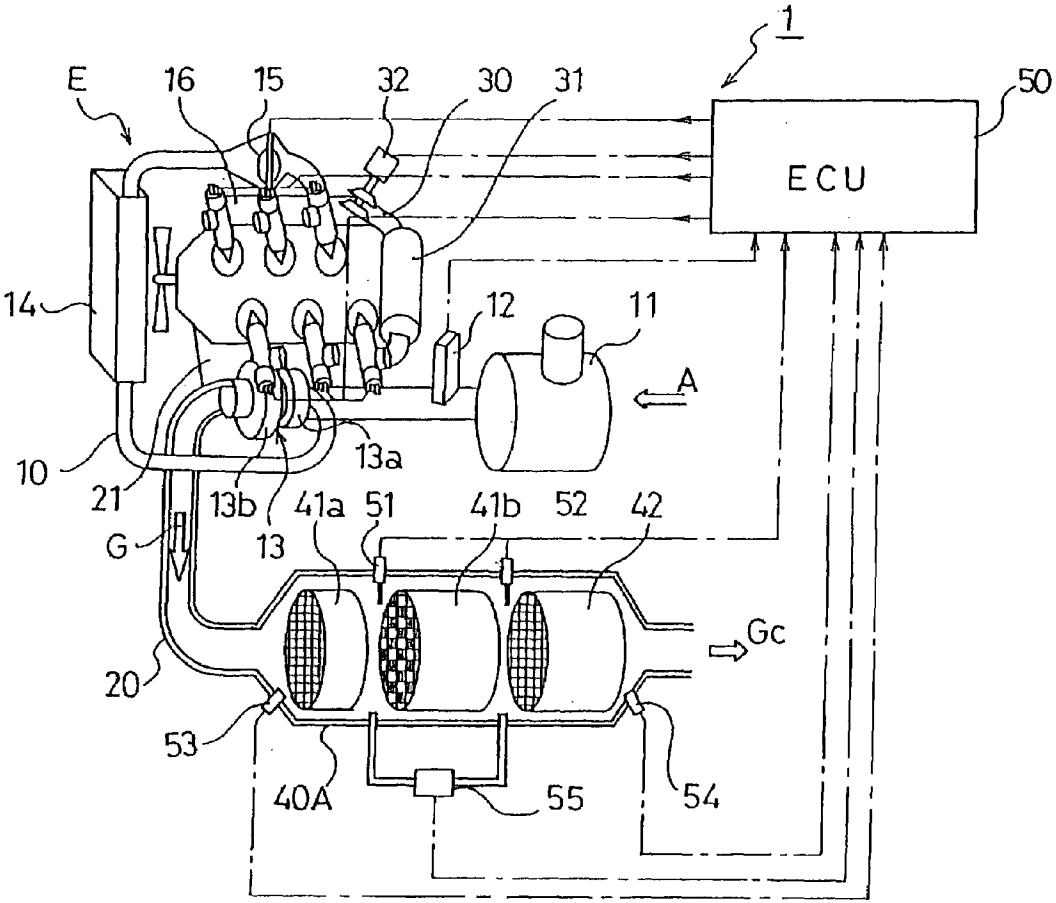
FIG. 1 is an illustration showing a constitution of an exhaust gas purifying system of an embodiment of the present invention.

FIG. 1 shows a constitution of an exhaust gas purifying system 1 of an embodiment. The exhaust gas purifying system 1 is constituted of including an exhaust passage 20 of an exhaust gas purifying apparatus 40A in an engine (internal combustion engine) E. The exhaust gas purifying apparatus 40A is constituted providing with an oxidation catalyst (DOC) 41*a*, a DPF 41*b*, and a NOx occluding reduction type catalyst converter 42 in order from the upstream side. Moreover, a continuously regenerating type DPF 41 is constituted of the upstream-side oxidation catalyst 41*a* and the downstream-side DPF 41*b*.

The oxidation catalyst 41*a* is formed by a monolith catalyst having a lot of polygonal cells formed by a structural material of cordierite, SiC, or stainless steel. A catalyst coat layer occupying the surface area is present in inner walls of the cells to make the support surface large. This large surface supports a catalyst metal such as platinum or vanadium. A catalyst function is generated through the catalyst metal, and thereby it is possible to change NO in exhaust gas to $NO_2$ in accordance with an oxidation reaction ($NO+O \rightarrow NO_2$).

Moreover, the DPF 41*b* can be formed by a monolith-honeycomb wall-flow filter obtained by alternately sealing entrances and exits of porous-ceramic honeycomb channels or a felt-like filter obtained by laminating inorganic fibers of alumina or the like at random. The DPF 41*b* collects the PM in the exhaust gas. The collected PM is burned and removed by $NO_2$ having a high oxidative power, by combining the PM with the upstream front-stage oxidation catalyst 41*a*.

The NOx occluding reduction type catalyst converter 42 is formed by a monolith catalyst similarly to the oxidation catalyst 41*a*. A catalyst coat layer is formed on the support body such as aluminum oxide or titanium oxide of the monolith catalyst to make the catalyst coat layer support a noble metal such as platinum and a NOx occluding material (NOx occluding substance) such as barium.

The NOx occluding reduction type catalyst converter 42 purifies the NOx in the exhaust gas by occluding the NOx in the exhaust gas in an exhaust gas state (lean air-fuel ratio state) having a high oxygen concentration. The NOx occluding reduction type catalyst converter 42 releases the occluded NOx and reduces the released NOx, when the oxygen concentration in the exhaust gas is low or zero (rich air-fuel ration state). Thereby, it is prevented that NOx discharges into the atmosphere.

Figure 2:
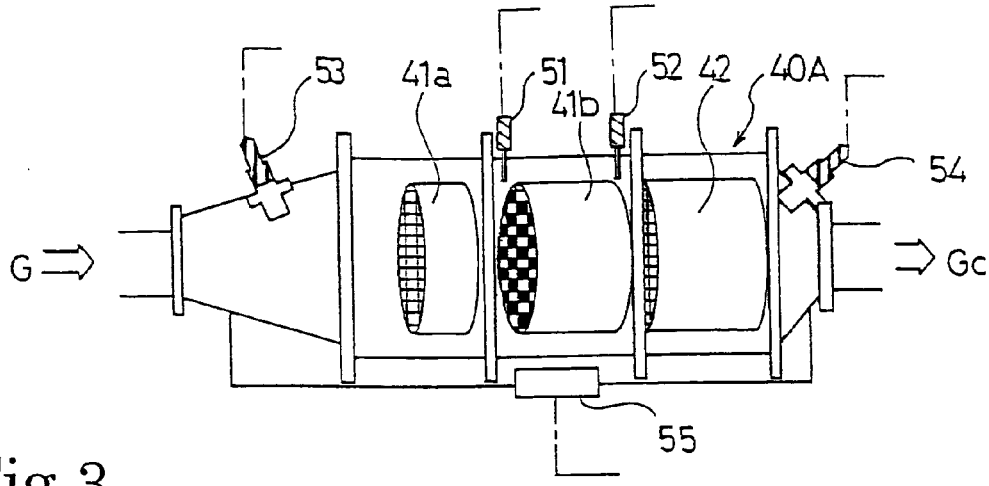
FIG. 2 is an illustration showing a constitution of an exhaust gas purifying apparatus of the first embodiment of the present invention.

The first temperature sensor 51 and the second temperature sensor 52 are provided on the upstream side and the downstream side of the DPF 41*b*. Furthermore, the fist exhaust concentration sensor 53 and the second exhaust concentration sensor 54 are provided on the front and the rear of the NOx occluding reduction type catalyst converter 42, that is, nearby the entrance and the exit of the exhaust gas purifying apparatus 40A in FIG. 1. The exhaust concentration sensors 53 and 54 are the sensors in which a λ (excess air factor) sensor, a NOx concentration sensor, and an $O_2$ concentration sensor are integrated. Moreover, to estimate the PM accumulation quantity, a differential pressure sensor 55 for detecting an exhaust differential pressure ΔP between the front and the rear of the DPF is provided on a conduction pipe connected to the front and the rear of the DPF 41*b* (FIG. 1) or the front and the rear of the exhaust gas purifying apparatus 40A (FIG. 2).

Output values of these sensors are input to a control unit (ECU: engine control unit) 50. The control unit 50 performs the overall control of operations of the engine E and performs the regeneration control of the continuously regenerating type DPF 41 and the regeneration control of the NOx purification capacity of the NOx occluding reduction type catalyst converter 42. Moreover, a common-rail electronic-control fuel-injection system for fuel injection of the engine E, a throttle valve 15, an EGR valve 32, and the like are controlled in accordance with control signals output from the control unit 50.

Based on detection values CNOx1 and CNOx2 obtained by the first and second exhaust concentration sensors 53 and 54, the control unit 50 calculates a NOx purifying rate RNOx (=1.0−CNOx2/CNOx1). Furthermore, the PM accumulation quantity of the DPF 41*b* is estimated based on the differential pressure ΔP detected by the differential pressure sensor 55 or the like.

In the exhaust gas purifying system 1, air A passes through an air cleaner 11, a mass air flow (MAF) sensor 12, a compressor 13*a* of a turbocharger 13 and an intercooler 14 in an intake passage 10, and the quantity of the air A is adjusted by a throttle valve 15 to enter a cylinder through an intake manifold 16.

Moreover, the exhaust gas G generated in the cylinder drives a turbine 13*b* of the turbocharger 13 in an exhaust passage 20 from an exhaust manifold 21. Then, the exhaust gas G passes through the exhaust gas purifying apparatus 40A to become the purified exhaust gas Gc and is discharged to the atmosphere by passing through a not-illustrated silencer. Furthermore, some of the exhaust gas G passes through an EGR cooler 31 in an EGR passage 30 to be re-circulated to the intake manifold 16, and the quantity is adjusted through an EGR valve 32.

Figure 3:
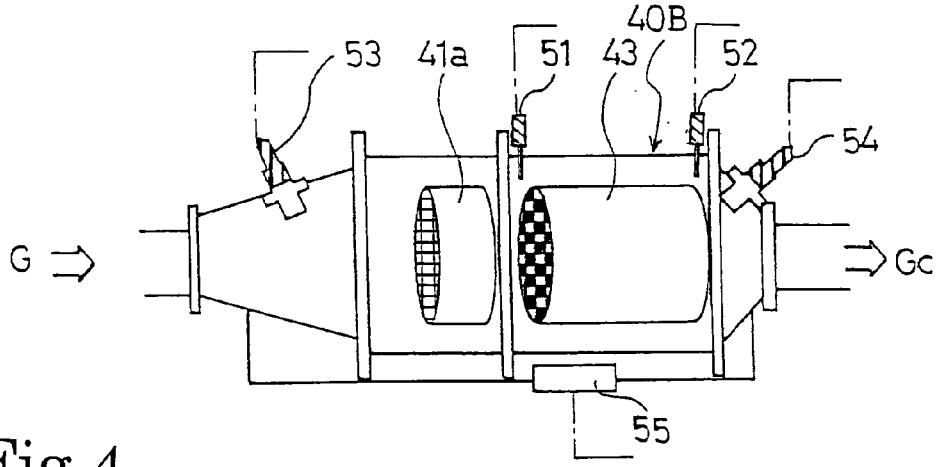
FIG. 3 is an illustration showing a constitution of an exhaust gas purifying apparatus of the second embodiment of the present invention.
Figure 4:
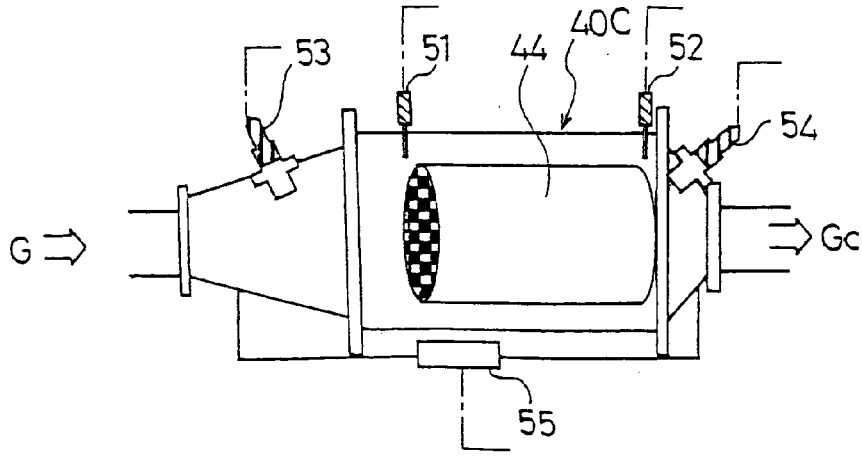
FIG. 4 is an illustration showing a constitution of an exhaust gas purifying apparatus of the third embodiment of the present invention.

FIG. 2 shows the exhaust gas purifying apparatus 40A. FIGS. 3 and 4 show constitutions of exhaust gas purifying apparatuses 40B and 40C of other embodiments. The exhaust gas purifying apparatus 40B in FIG. 3 is constituted of the oxidation catalyst 41*a* and a DPF 43 supporting a NOx reduction type catalyst. The exhaust gas purifying apparatus 40C in FIG. 4 is constituted of the oxidation catalyst 41*a* and a DPF with a catalyst 44 supporting a NOx reduction type catalyst. The DPF with the catalyst includes a DPF supporting an oxidation catalyst and a DPF supporting an oxidation catalyst and a PM oxidation catalyst.

The PM oxidation catalyst is made of the oxide of cerium (Ce) or the like. In the case of a catalyst-carrying filter carrying the PM oxidation catalyst and the oxidation catalyst, PM is oxidized in accordance with a reaction ($4CeO_2+C \rightarrow 2Ce_2O_3+CO_2$, $2Ce_2O_3+O_2 \rightarrow 4CeO_2$, or the $O_2$ in exhaust gas in the catalyst-carrying filter at a low temperature (between 300° C. and 600° C.), while PM is oxidized by $O_2$ in the exhaust gas at a temperature (600° C. or higher) higher than the temperature at which the PM is burned by $O_2$ in the exhaust gas.

Moreover, there are the following apparatuses as an exhaust gas purifying apparatus having no oxidation catalyst at the upstream side. They are the exhaust gas purifying apparatus constituted of a DPF not having a catalyst but having only a filter and a NOx occluding reduction type catalyst converter; the exhaust gas purifying apparatus constituted of a DPF with a catalyst carrying an oxidation catalyst and a NOx occluding reduction type catalyst converter; and the exhaust gas purifying apparatus DPF with a catalyst supporting an oxidation catalyst and a PM oxidation catalyst and a NOx occluding reduction type catalyst converter.

In short, any exhaust gas purifying apparatus may be used as the exhaust gas purifying apparatus of the present invention as long as the apparatus performs NOx purification by the NOx occluding reduction type catalyst and PM purification by the DPF for the exhaust gas of the engine.

Figure 5:
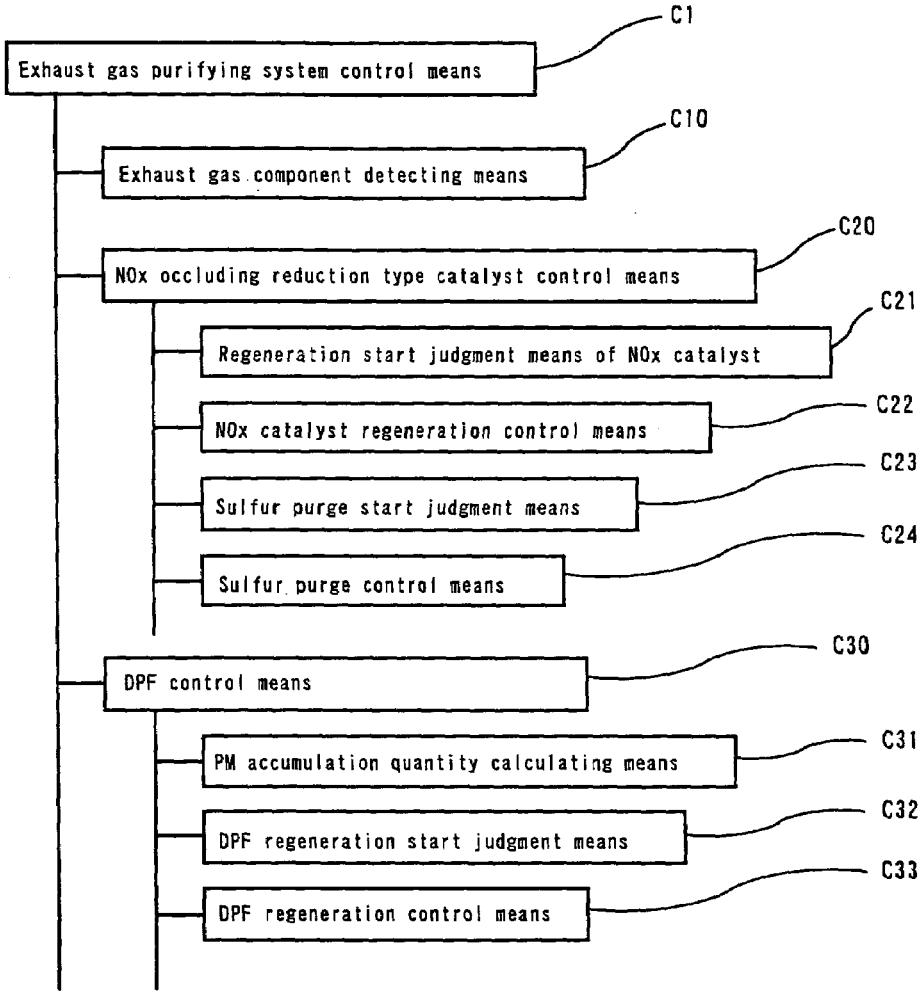
FIG. 5 shows the configuration of the control means for the exhaust gas purifying system according to an embodiment of the present invention.

Moreover, the control unit of the exhaust gas purifying system 1 is built in the control unit 50 of the engine E to control operations of the engine E and the exhaust gas purifying system 1. As shown in FIG. 5, the control unit of the exhaust gas purifying system 1 is constituted by including a control means C1 of the exhaust gas purifying system having an exhaust gas component detecting means C10, a NOx occluding reduction type catalyst control means C20, and a DPF control means C30.

The exhaust gas component detecting means C10 is the means for detecting the oxygen concentration and the NOx concentration in exhaust gas and is constituted of the first and second exhaust concentration sensors 53 and 54.

The NOx occluding reduction type catalyst control means C20 is the means for regenerating the NOx occluding reduction type catalyst converter 42 and controlling a sulfur purge and is constituted by including a regeneration start judgment means of NOx catalyst C21, a NOx catalyst regeneration control means C22, a sulfur purge start judgment means C23, and a sulfur purge control means C24.

The NOx occluding reduction type catalyst control means C20 calculates a NOx purification rate RNOx based on the NOx concentration detected by the exhaust gas component detecting means C10. Moreover, when the NOx purification rate RNOx becomes lower than a predetermined judgment value, the means 20C regenerates the NOx catalyst by judging that regeneration of the NOx catalyst is started. This regeneration brings an exhaust gas state into a predetermined rich air-fuel ratio state and a predetermined temperature range (between approximately 200° C. and 600° C. though depending on a catalyst) by performing post injection in the fuel injection control of the engine E, EGR control, and intake-air throttling control by the NOx-catalyst regeneration control means C22. Thereby, the NOx purification capacity, that is, the NOx occlusion capacity is recovered. Moreover, the NOx occluding reduction type catalyst control means C20 performs the sulfur purge by the sulfur purge start judgment means C23 and the sulfur purge control means C24.

The DPF control means C30 is constituted by including a PM accumulation quantity calculating means C31, a DPF regeneration start judgment means C32, and a DPF regeneration control means C33.

The DPF control means C30 calculates the PM accumulation quantity of the DPF 41*b* based on the differential pressure ΔP detected by the differential pressure sensor 55 by the PM accumulation quantity calculating means C31. The DPF regeneration start judgment means C32 judges whether the clogging state of the DPF 41*b* exceeds a predetermined clogging state depending on whether the PM accumulation quantity exceeds a predetermined judgment value. When DPF regeneration start is judged, the DPF regeneration control means C33 raises an exhaust gas temperature through post injection, EGR control, and the like, and the DPF 41 is regenerated.

Figure 6:
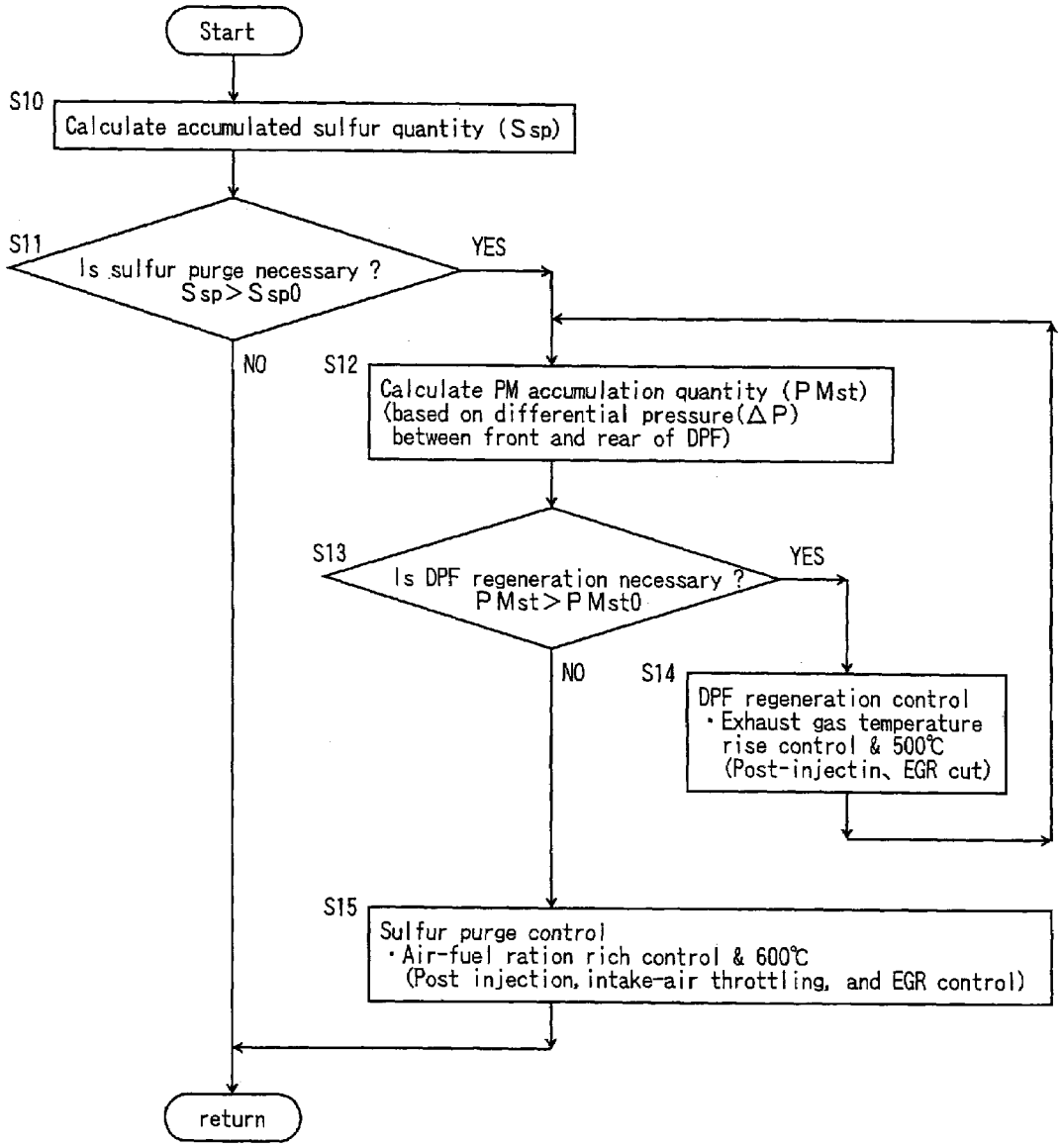
FIG. 6 is an illustration showing a control flow for a sulfur purge of an exhaust gas purifying method of an embodiment of the present invention.

In the case of these exhaust gas purifying systems 1, the exhaust gas purifying method of NOx occluding reduction type catalyst of the present invention is performed in accordance with the sulfur purge control flow shown in FIG. 6.

The control flow in FIG. 6 is a control flow relating to the sulfur purge of the NOx occluding reduction type catalyst. The control flow is executed by being repeatedly called from the control flow of the whole exhaust gas purifying system together with the control flow relating to the regeneration of the NOx occluding capacity of the NOx occluding reduction type catalyst converter 42 or the regeneration control flow of the DPF 41*b*, or the like. The above control flow is shown as a flow for judging the necessity of the sulfur purge and if required, performing the sulfur purge control after performing the regeneration control of the DPF according to necessity.

When the above control flow starts, the sulfur quantity occluded in the catalyst 42 is calculated based on the fuel consumption and the sulfur quantity contained in the fuel in step S10. By integrating the sulfur quantity occluded in the catalyst 42, an accumulated sulfur quantity Ssp is calculated. Then, in the next step S11, it is judged whether a sulfur purge is required or not by the sulfur purge start judgment means C23. In the case of this judgment, when the accumulated sulfur quantity Ssp becomes larger than a predetermined limit value Sso0, it is judged that the sulfur purge is required.

When it is judged that the sulfur purge is not required in the step S11, the sulfur purge control flow is then completed and the flow returns. However, when it is judged that the sulfur purge is required, step S12 is started. In the step S12, a PM accumulation quantity PMst of the DPF 41*b* is calculated by the PM accumulation quantity calculating means C31 based on the differential pressure ΔP detected by the differential pressure sensor 55 or the like.

In the next step S13, it is judged whether or not the PM accumulation quantity PMst is larger than a predetermined judgment value PMst0. The predetermined judgment value PMst0 is different from the regeneration start judgment value of the DPF 41*b*, and is set to a value, by which, a temperature rise and oxygen consumption in the exhaust gas incoming to the NOx occluding reduction type catalyst converter 42, can be estimated when burning the PM accumulated in the DPF 41*b*.

When it is judged in the determination that the PM accumulation quantity PMst is equal to or less than the judgment value PMst0 in the step S13, step S15 is started. However, when it is judged that the PM accumulation quantity PMst is larger than the predetermined judgment value PMst0, the exhaust gas temperature rise control for the DPF regeneration is performed by the DPF regeneration control means C33 in step S14, and step S15 is then started.

In the case of the exhaust gas temperature rise control for DPF regeneration in the step S14, the exhaust gas temperature is raised through performing post injection in the fuel injection of the engine or cutting the EGR. The exhaust gas temperature is controlled so as to enter a PM self-ignition region and a temperature region free from abnormal combustion (approximately 500° C.). In the temperature control, the fuel quantity for the post injection is adjusted by performing feedback control while monitoring the temperature detected by the temperature sensor 52.

The PM accumulated in the DPF 41*b* is forcibly burned and removed through the above exhaust gas temperature rise. Moreover, temperatures of the DPF 41*b*, the exhaust gas, and the NOx occluding reduction type catalyst converter 42 are raised by the burning heat of the PM, and the oxygen concentration in the exhaust gas passing through the DPF 41*b* is lowered by the burning of the PM.

Furthermore, after performing the DPF regeneration control in the step S14, the flow is returned to the step S12. For a predetermined time, the flow from the step S12 to the step S14 are repeated until the PM accumulation quantity PMst becomes the predetermined judgment value PMst0 or less. The predetermined time is a time relating to the interval for judging the quantity of the PM accumulation quantity PMst. In this repetition, when the PM accumulation quantity PMst becomes the predetermined judgment value Mst0 or less, the step S15 is started.

In the step S15, the sulfur purge control is performed. In the case of the sulfur purge control, feedback control is performed so that the oxygen concentration detected by the second exhaust concentration sensor 54 becomes a predetermined oxygen concentration by performing the post injection, the intake-air throttling, and the EGR control to make the air-fuel ratio of the exhaust gas incoming to the NOx occluding reduction type catalyst converter 42 rich.

Then, the sulfur purge control is performed until the accumulated sulfur quantity exceeds the accumulated sulfur quantity Ssp calculated or predetermined judgment value Ssp0 in step S10 and then completed. The accumulated sulfur quantity is calculated based on the temperatures detected by the first and second temperature sensors 51 and 52, an operation state of an engine, and a sulfur purge quantity integrated value calculated in accordance with a previously-input sulfur purge quantity map The sulfur purge quantity integrated value is calculated based on the temperatures detected by the first and second temperature sensors 51 and 52, the operation state of an engine, and previously-input sulfur purge quantity map. When the sulfur purge control in the step S15 is completed, the flow returns.

In this step S15, because the temperature of the NOx occluding reduction type catalyst converter 42 is also previously raised by the PM regeneration control in the step S14, it is possible to change the temperature of the NOx occluding reduction type catalyst converter 42 to a sulfur purge temperature (approximately 600° to 650° C. though depending on a catalyst) in a short time. Moreover, because of the PM burning continuously performed by the DPF 41, a certain degree of oxygen is consumed. Then, it is not required to realize a complete rich state immediately after the exhaust manifold 21 of the engine E. Therefore, even in a shallow rich state having an excess air factor λ of 1.02 to 1.05, it is possible to bring the NOx occluding reduction type catalyst converter 42 into a rich atmosphere in which sulfur can be purged.

Therefore, in the case of the sulfur purge control, it is possible to efficiently perform the sulfur purge while preventing fuel consumption from deteriorating and preventing HC and CO from discharging into the atmosphere. The NOx occluding capacity is also regenerated since the NOx occluded by the NOx occluding material is released together with the sulfur purge. The NOx discharged (released) in this case is reduced to $N_2$ and $H_2O$ by reducers such as HC and CO in exhaust gas.

Figure 7:
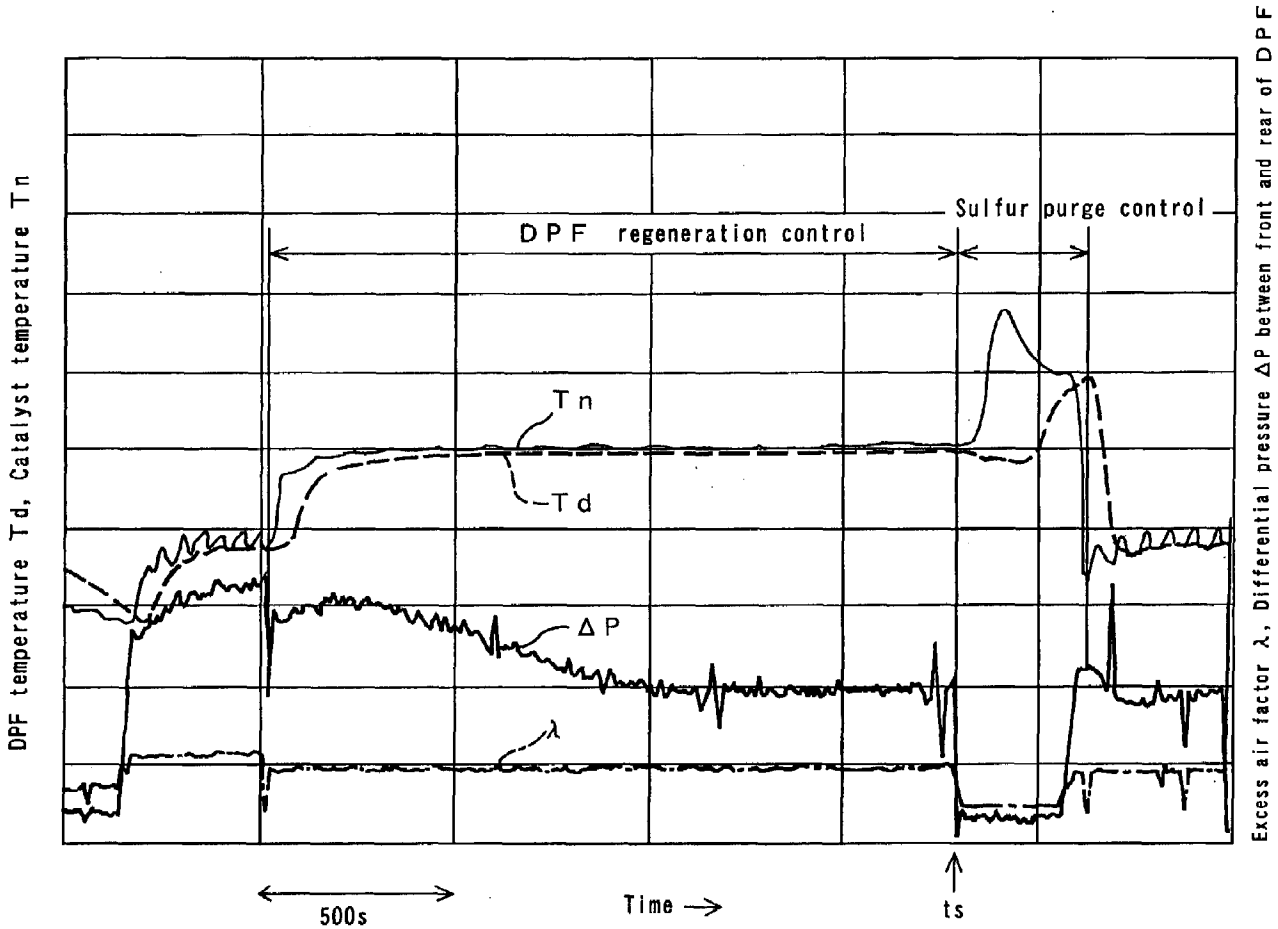
FIG. 7 is an illustration showing a time series of the excess air factor, differential pressure between the front and the rear of a DPF, the temperature of the DPF, and the temperature of a NOx occluding reduction type catalyst converter of an embodiment using a control flow for a sulfur purge of an exhaust gas purifying method of an embodiment of the present invention.

FIG. 7 shows the excess air factor λ, the differential pressure ΔP between the front and the rear of the DPF, DPF temperature (bed temperature of DPF) Td, and catalyst temperature (bed temperature of NOx occluding reduction type catalyst converter) Tn when performing the sulfur purge in accordance with the control flow shown in FIG. 5 by using the exhaust gas purifying apparatus shown in FIG. 2.

According to FIG. 7, when setting the excess air factor λ to approximately 1.0 by performing the DPF regeneration control, the DPF temperature Td and the catalyst temperature Tn are raised and kept at an almost constant temperature (approximately 500° C.). Moreover, because the differential pressure ΔP between the front and the rear of the DPF slowly decreases, it is appreciated that burning of PM is progressed. Furthermore, when starting the sulfur purge control at the time of ts and realizing a rich state by further decreasing the excess air factor λ through intake-air throttling or the like, the catalyst temperature Tn is extremely raised. According to the rise of the catalyst temperature Tn, the sulfur accumulated in the NOx occluding reduction type catalyst is efficiently purged.

What is claimed is:

1. An exhaust gas purifying method, using an exhaust gas purifying system which performs NOx purification by a NOx occluding reduction type catalyst and PM purification by a DPF for exhaust gas of an internal combustion engine and has a control unit, the control unit being provided with a regeneration start judgment means of a NOx catalyst, a NOx catalyst regeneration control means, a sulfur purge start judgment means, a DPF regeneration start judgment means, and a DPF regeneration control means, comprising the steps of:

judging whether the sulfur purge of a NOx occluding reduction type catalyst is required, further judging whether the PM accumulation quantity collected in the DPF exceeds a predetermined value when the sulfur purge is judged to be required, and performing a sulfur purge control after performing the DPF regeneration control when the PM quantity exceeds the predetermined value;

wherein the predetermined value is a value different from a regeneration start judgment value by which, when PM accumulated in the DPF is burned, a temperature rise of the exhaust gas and consumption of oxygen in the exhaust gas entering the NOx occluding reduction type catalyst is estimated.

2. An exhaust gas purifying system, which performs NOx purification by a NOx occluding reduction type catalyst and PM purification by a DPF for exhaust gas of an internal combustion engine and has a control unit, the control unit being provided with a NOx-catalyst regeneration start judgment means, a NOx catalyst regeneration control means, a sulfur purge start judgment means, a sulfur purge control means, a PM accumulation quantity calculating means, a DPF regeneration start judgment means, and a DPF regeneration control means, wherein whether the sulfur purge of a NOx occluding reduction type catalyst is required is judged;

whether the PM accumulation quantity collected in the DPF exceeds a predetermined value is further judged when the sulfur purge is judged to be required;

a sulfur purge control is performed after performing the DPF regeneration control when the PM quantity exceeds the predetermined value; and the control unit sets the predetermined value to be a value different from a regeneration start judgment value of the DPF and is set to a value by which, when PM accumulated in the DPF is burned, temperature rise of the exhaust gas and consumption of oxygen in the exhaust gas entering the NOx occluding reduction type catalyst estimated.

* * * * *

UNITED STATES PATENT AND TRADEMARK OFFICE

CERTIFICATE OF CORRECTION

PATENT NO. : 7,207,171 B2
APPLICATION NO. : 10/926331
DATED : April 24, 2007
INVENTOR(S) : Daiji Nagaoka et al.

It is certified that error appears in the above-identified patent and that said Letters Patent is hereby corrected as shown below:

Title Page, Column 2, Line 1, under "Foreign Patent Documents" change "2/1907" to --02/2007--.

Column 12, Line 10, after "catalyst" insert --is--.

Signed and Sealed this

Seventh Day of August, 2007

JON W. DUDAS
*Director of the United States Patent and Trademark Office*